US008636023B2

(12) United States Patent
Burkhart et al.

(10) Patent No.: US 8,636,023 B2
(45) Date of Patent: Jan. 28, 2014

(54) AUTOMATIC AIR VENT FOR FIRE SUPPRESSION WET PIPE SYSTEM AND METHOD OF VENTING A FIRE SUPPRESSION WET PIPE SYSTEM

(75) Inventors: David J. Burkhart, Wentzville, MO (US); Edward A. Schultz, Chesterfield, MO (US)

(73) Assignee: Engineered Corrosion Solutions, LLC, St. Louis, MO (US)

( * ) Notice: Subject to any disclaimer, the term of this patent is extended or adjusted under 35 U.S.C. 154(b) by 813 days.

(21) Appl. No.: 12/615,738

(22) Filed: Nov. 10, 2009

(65) Prior Publication Data

US 2011/0108123 A1 May 12, 2011

(51) Int. Cl.
*A62C 35/00* (2006.01)

(52) U.S. Cl.
USPC ..... 137/202; 137/558; 137/559; 137/613; 96/164; 169/16

(58) Field of Classification Search
USPC ..... 137/171, 173, 197, 199, 202, 312, 551, 137/558, 559, 613; 169/10, 16–19; 96/158, 96/159, 162–165, 168, 187
See application file for complete search history.

(56) References Cited

U.S. PATENT DOCUMENTS

| | | | | |
|---|---|---|---|---|
| 1,459,594 | A * | 6/1923 | McWhorter et al. | 137/173 |
| 3,969,092 | A * | 7/1976 | Huffman et al. | 96/164 |
| 4,197,097 | A * | 4/1980 | Magorien et al. | 96/163 |
| 6,926,023 | B2 * | 8/2005 | Cabral et al. | 137/202 |

* cited by examiner

*Primary Examiner* — Eric Keasel
(74) *Attorney, Agent, or Firm* — Harness, Dickey & Pierce, P.L.C.

(57) ABSTRACT

A fire suppression wet pipe system air vent assembly and method of venting air from a fire suppression wet pipe system includes providing a primary air vent valve having an inlet and an outlet. The primary air vent inlet is adapted to be connected with a fire suppression wet pipe system and is configured to vent air, but not water, from its outlet. A secondary air vent valve having an inlet and an outlet is provided. The secondary air vent valve is configured to vent air, but not water, from its outlet. A fluid conduit connects the primary air vent valve outlet with the secondary air vent valve inlet. The second air vent valve provides failsafe air venting upon the failure of the primary air vent valve. A fluid indicator may be provided that indicates the presence of fluid in the conduit. The presence of an appreciable amount of fluid in the conduit is an indication of likely failure of the primary air vent valve.

20 Claims, 6 Drawing Sheets

AUTOMATIC AIR VENT FOR FIRE SUPPRESSION WET PIPE SYSTEM AND METHOD OF VENTING A FIRE SUPPRESSION WET PIPE SYSTEM

BACKGROUND OF THE INVENTION

The present invention is directed to a method and apparatus for venting air from a fluid system and, in particular, to a method and apparatus for venting air from a fire suppression wet pipe system.

Fire suppression wet pipe systems, such as water-based fire-sprinkling systems, fire suppression stand pipe systems, and the like, when placed in service and when occasionally drained in order to perform maintenance or changes on the system will have air in the piping network. When the piping network of the system is refilled with water, air becomes trapped in the system. This trapped air can cause internal corrosion of the piping network, especially when mild steel or galvanized piping is being used. Oxygen corrosion may be the predominant form of corrosion and metal loss within the fire protection system. Oxygen may enter the fire sprinkler system piping from two sources. First, oxygen may be dissolved in the incoming fresh water that is used to fill the fire sprinkler piping. Second, oxygen is present in any air that is trapped in the fire sprinkler system. Corrosion of mild steel fire sprinkler piping can, therefore, be most active when fresh oxygenated water and air are introduced into the piping during any drain and fill cycle. Draining and refilling the system allows additional corrosion. Each time the system is drained of the fluids and refilled, the high rate of oxygen corrosion that exists with a fresh supply of air will cause additional metal lost from the pipe walls.

To reduce the amount of internal corrosion within the piping network, the fire suppression wet pipe system is vented when it is filled or refilled. While this is commonly performed manually, an air vent valve may be connected at an upper portion of the system to automatically vent the air that rises to that portion of the system. Such air vent valves are configured to close after the air has been removed from the system to prevent any appreciable amount of fluid from being discharged. However, should the air vent valve fail, it may result in extensive discharge of fluid, which could cause water damage to the structure and any goods stored or displayed in the structure, such as a warehouse or retail space, especially if not discovered immediately. Indeed, for systems that operate at a high pressure, such as fire-sprinkling systems, a failed air vent valve may be capable of discharging a very large amount of fluid in a very short amount of time.

SUMMARY OF THE INVENTION

A fire suppression wet pipe system air vent assembly that provides a method of automatically venting air from a fire suppression system wet piping network, according to an aspect of the invention, includes providing a primary air vent valve having an inlet and an outlet. The primary air vent inlet is adapted to be connected with the wet pipe system and is configured to vent air, but not water from its outlet. A secondary air vent valve having an inlet and an outlet is provided. The secondary air vent valve is configured to vent air, but not water from its outlet. A fluid conduit connects the primary air vent valve outlet with the secondary air vent valve inlet. The secondary air vent valve provides failsafe air venting upon failure of the primary air vent valve. This provides redundancy to the primary air vent valve while functioning in generally the same manner as the primary air vent valve alone.

The fluid conduit may include a vertically elongated chamber. The secondary air vent valve inlet may be connected above a bottom portion of the chamber, thereby defining a fluid collection space. This allows small amounts of fluid discharged from the primary air vent valve to be accumulated without entering the secondary air vent valve. Such small amounts of fluid should be evaporated by exposure to atmosphere through the secondary air vent valve. The vertically elongated chamber may be in the form of an enclosed chamber.

A fluid responsive valve may be connected with the secondary air vent valve outlet. The fluid responsive valve is normally open and closes in response to fluid at the outlet of the secondary air vent valve. The fluid responsive valve may be a reusable valve.

A fire protection wet pipe system air vent assembly and method of venting air from a fluid system, according to another aspect of the invention, includes providing a primary air vent valve having an inlet and an outlet. The primary air vent inlet is adapted to be connected with a fire protection wet pipe system and is configured to vent air, but not water from its outlet. A secondary air vent valve having an inlet and an outlet is provided. The secondary air vent valve is configured to vent air, but not water from its outlet. A fluid conduit connects the primary air vent valve outlet with the secondary air vent valve inlet. A fluid indicator is provided that indicates the presence of fluid in the conduit. The secondary air vent valve provides failsafe air venting upon failure of the primary air vent valve. The fluid indicator indicates failure of the primary air vent valve. In particular, the presence of an appreciable amount of fluid in the conduit is an indication of likely failure of the primary air vent valve.

The fluid indicator may be, in the form of a visual indicator. The visual indicator may be visible from below the fluid conduit. The visual indicator may be in the form of a sight glass at a bottom portion of the conduit and an indicator element in the conduit that floats away from the sight glass in the presence of fluid in the conduit.

The conduit may include a vertically elongated chamber. The fluid indicator may be in the form of a float switch in the chamber. The fluid indicator may be in the form of both a visual indicator and a float switch in the chamber.

A fluid responsive valve may be connected with the secondary air vent valve outlet. The fluid responsive valve is normally open and closes in response to fluid at the outlet of the secondary air vent valve. The fluid responsive valve may be a reusable valve.

These and other objects, advantages, and features of this invention will become apparent upon review of the following specification in conjunction with the drawings.

DESCRIPTION OF THE PREFERRED EMBODIMENT

Figure 1:
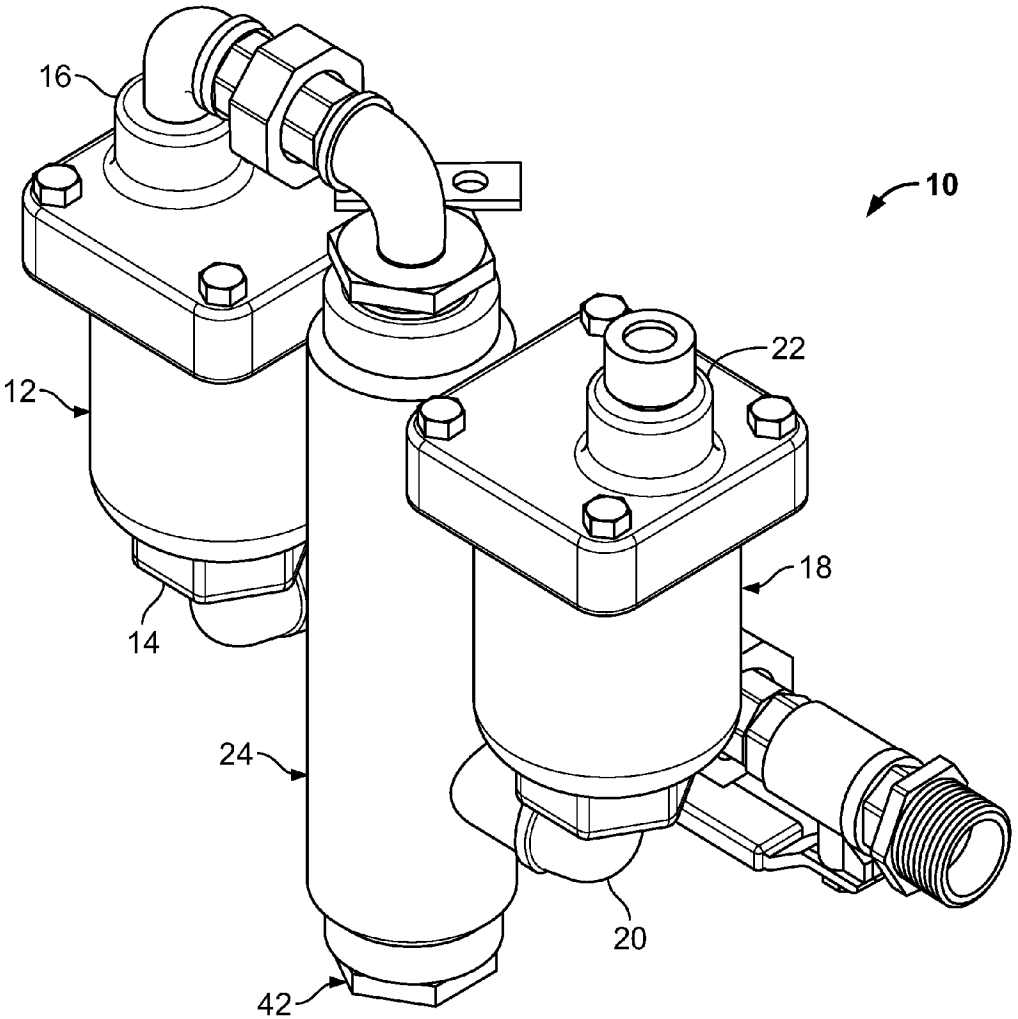
FIG. 1 is a perspective view of a fire suppression wet pipe system air vent assembly, according to an embodiment of the invention.
Figure 2:
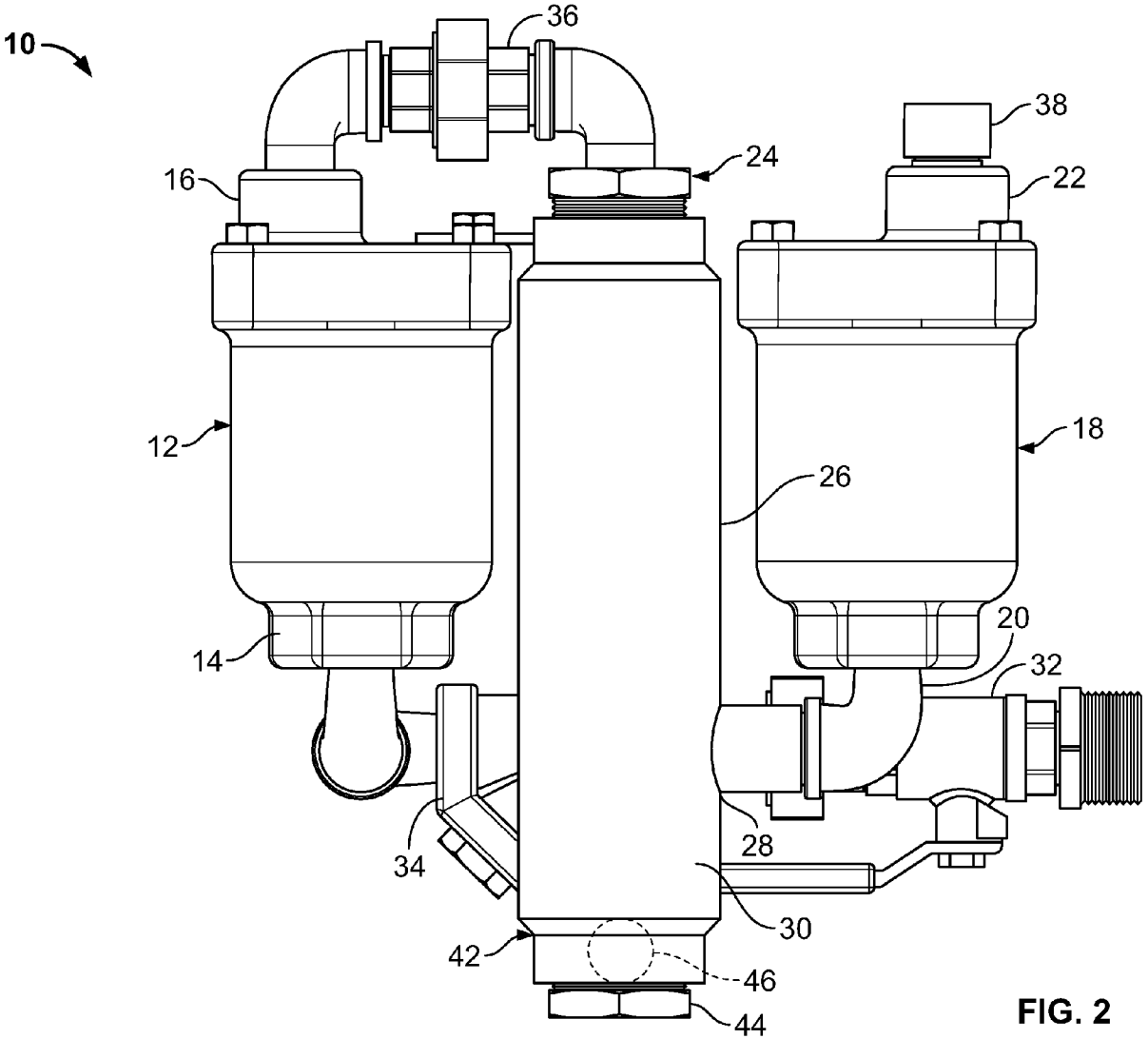
FIG. 2 is a front elevation of the wet pipe system air vent assembly of FIG. 1.
Figure 3:
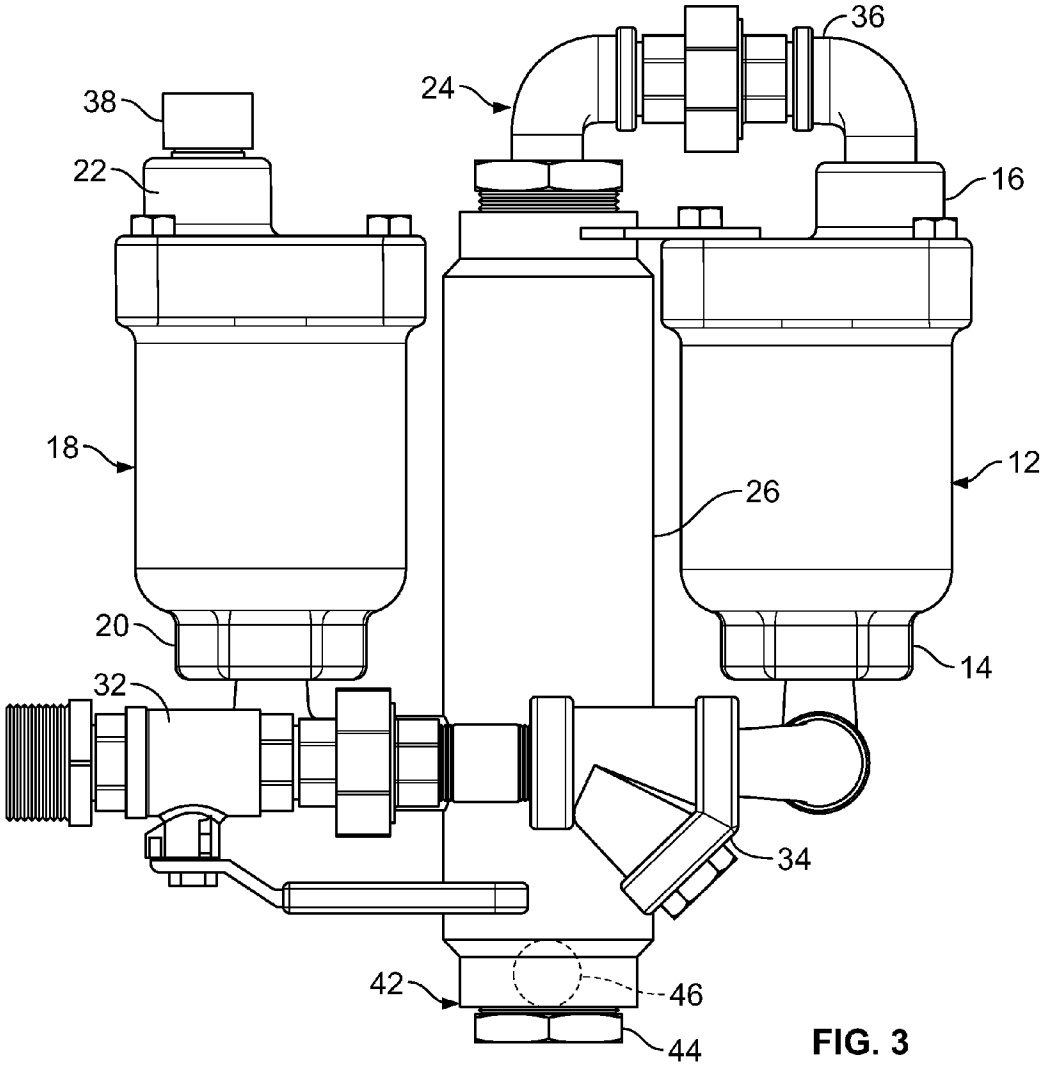
FIG. 3 is a rear elevation of the wet pipe system air vent assembly of FIG. 1.

Referring now to the drawings and the illustrative embodiments depicted therein, a fire suppression wet pipe system air vent assembly 10 includes a primary air vent valve 12 and a secondary air vent valve 18 interconnected by a fluid conduit 24 (FIGS. 1-3). Primary air vent valve 12 has an inlet 14 and an outlet 16. Primary air vent inlet 14 is adapted to be connected with the fire suppression wet pipe system, such as through a cutoff valve 32 and a Y-strainer 34. Cutoff valve 32 allows all or a portion of the air vent assembly 10 to be removed from the fluid system for service. The Y-strainer removes sediment, and the like, that may result from fluid flow in the fluid system breaking loose corrosion products from the walls of the system. The strainer prevents such sediment from reaching and thereby clogging small orifices in the air vent valves. Primary air vent valve 12 is configured to vent air, but not water present in the fluid system from passing to its outlet 16.

Secondary air vent valve 18 has an inlet 20 and an outlet 22. Secondary air vent valve 18 is also configured to vent air, but not water present at its inlet from passing to its outlet. Fluid conduit 24 connects primary air vent valve outlet 16 with secondary air vent valve inlet 20. In the illustrative embodiment, primary and secondary air vent valves 12, 18 are commercially available. While they are illustrated as being identical, they could be of a different configuration. In the illustrative embodiment, valves 12, 18 are supplied by APCO Willamette Corporation.

In the illustrative embodiment, fluid conduit 24 is made up of a vertically elongated chamber 26 that is connected at an upper portion thereof with outlet 16 through a coupling 36. The secondary air vent valve inlet is connected to chamber 26 at a tap 28 that is above the bottom portion of chamber 26 thereby defining a fluid collection space 30. In the illustrated embodiment, chamber 26 is an enclosed chamber. Secondary air vent valve outlet 22 is covered with a cap screen 38 to allow air, and the like, to escape from outlet 22 while resisting insects, and the like, from entering into the valve.

Figure 4:
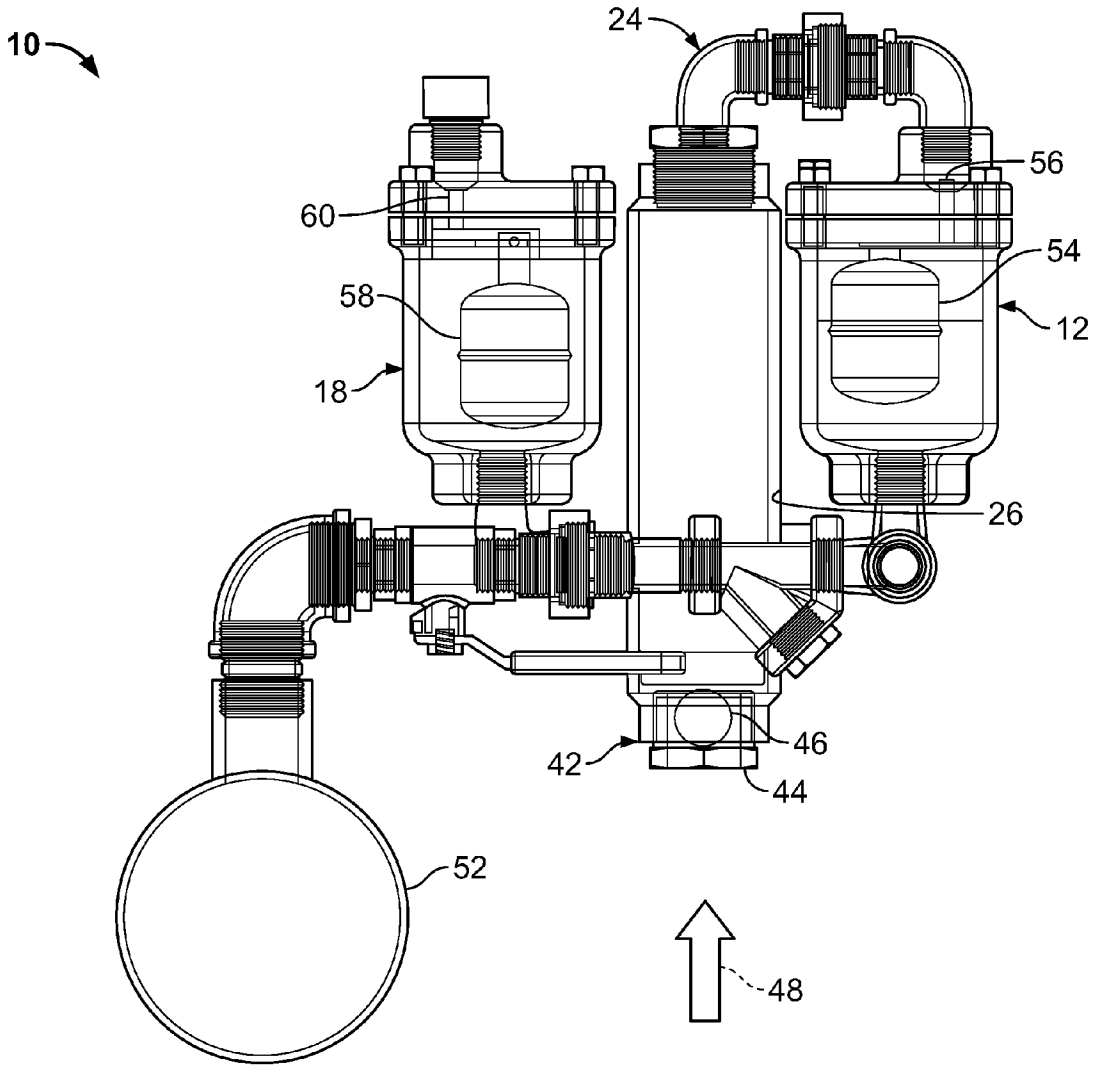
FIG. 4 illustrates a method of venting air from a wet pipe system, according to an embodiment of the invention, illustrating normal operating conditions.
Figure 5:
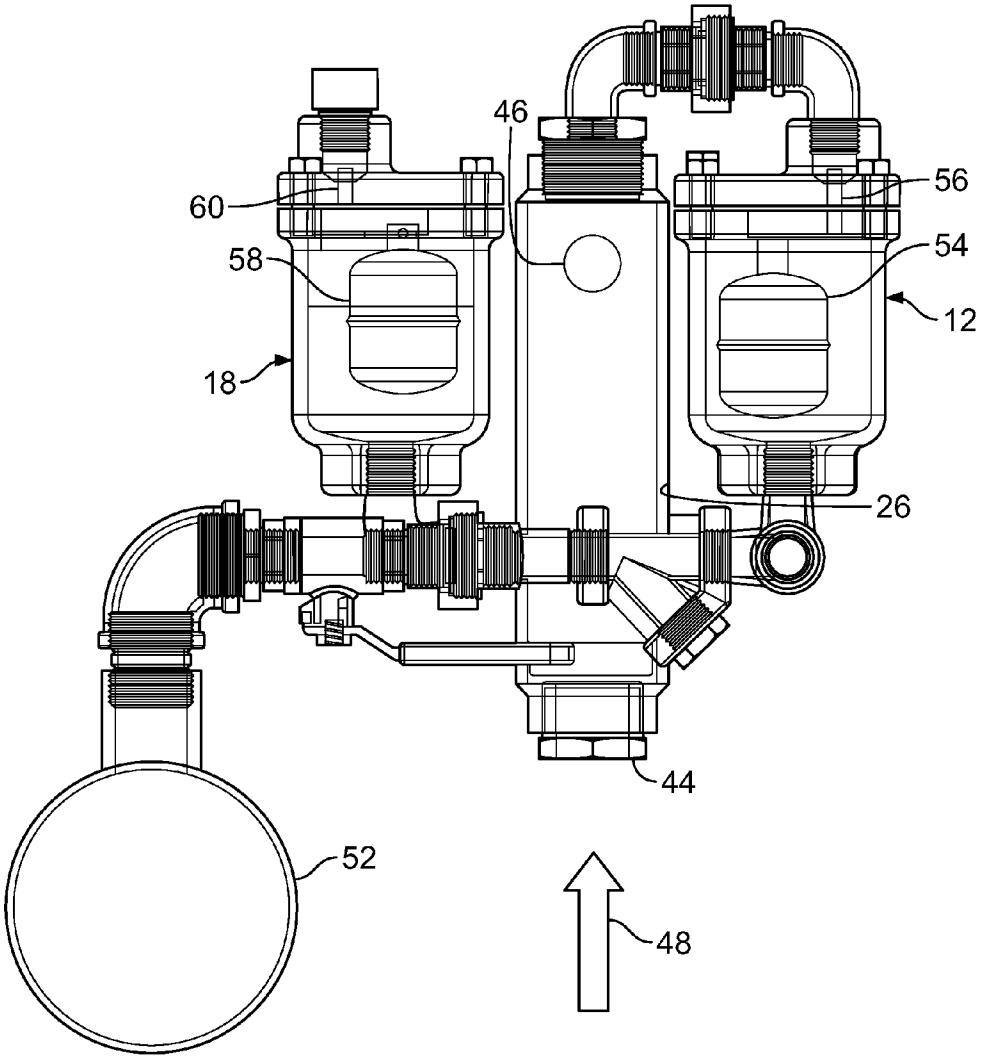
FIG. 5 is the same view as FIG. 4 illustrating failure of the primary air vent valve.

Fire suppression wet pipe system air vent assembly 10 may further include a fluid indicator that indicates the presence of fluid in chamber 26. In the embodiment illustrated in FIGS. 1-3, the fluid indicator is in the form of a visual indicator 42. The visual indicator is visible from below said chamber 26 as indicated by direction indicator 48, as seen in FIGS. 4 and 5. Visual indicator 42 is made up of a sight glass 44 at a bottom portion of chamber 26 and an indicator element 46 in the chamber that floats away from the sight glass in the presence of fluid in conduit 24. In particular, indicator element 46 is a spherical-shaped floating element.

Operation of fire suppression wet pipe system air vent assembly 10 can best be understood by reference to FIGS. 4 and 5 illustrated in FIG. 4. With assembly 10 connected with a fire suppression wet pipe system 52, air in system 52 escapes through an open orifice 56 in primary air vent valve 12, fluid conduit 24, and an open orifice 60 in secondary air vent valve 18. After the air is vented, the fluid enters primary air vent valve 12 and causes a float 54 therein to close orifice 56, thereby preventing an appreciable amount of fluid from escaping its outlet 16. Because no appreciable amount of fluid enters chamber 26 of fluid conduit 24, visual indicator 42 indicates a "safe" condition of assembly 10 because indicator element 46 is resting on or near sight glass 44. An observer, viewing from below assembly 10 as indicated at 48 is able to view indicator element 46 to observe that assembly 10 is operational. Because assembly 10 is positioned at a high point in the fire suppression wet pipe system 52, which can be several tens of feet above the floor, the construction of visual indicator 42 allows a maintenance technician to observe the operating condition of assembly 10 without the need to climb a ladder, or the like.

As illustrated in FIG. 5, if primary air vent valve 12 fails with orifice 56 open, the fluid from system 52 will pass through primary air vent valve outlet 16 to chamber 26 where it will fill up the chamber and pass into secondary air vent valve 18 through its inlet 20. This will cause a float 58 in valve 18 to close orifice 60, thereby preventing an appreciable amount of fluid from escaping from assembly 10. Moreover, the filling of chamber 26 with fluid causes indicator element 46 to float away from sight glass 44. Thus, the absence of indicator element 46 in sight glass 44 of visual indicator 42 will be a condition observable by the observer 48 from below assembly 10 that the assembly is not functioning normally. However, even though fire suppression wet pipe system air vent assembly 10 is not functioning in a normal manner, it still should prevent fluid from escaping from assembly 10 where it could cause damage.

Thus, the absence of indicator element 46 viewed through sight glass 44 is an indication that primary air vent valve 12 is likely malfunctioning. Assembly 10 can be repaired by the closing of cutoff valve 32, the removal of assembly 10 from fire suppression wet pipe system 52 and the replacement of primary air vent valve 12. Unlike other systems, there are no additional components in the assembly, such as a single action liquid sensitive switch, or the like, that must be replaced at the same time as the primary air vent valve. Moreover, because chamber 26 is sealed, casual water around the job site will not affect operation of assembly 10, as can occur with other air vent assemblies that employ liquid sensitive switches in an open container. In the illustrated embodiment, visual indicator 42 can be observed from a distance of up to approximately 30 feet or more.

Secondary air vent valve 18 allows airflow from chamber 26 during normal operation of assembly 10. This venting of chamber 26 allows any fluid that casually enters chamber 26 to evaporate over time through valve 18. This is useful because primary air vent valve 12 may discharge small amounts of fluid during the interval that air has escaped the system, but before orifice 56 is fully closed. Over time, such small amount of fluid will evaporate through orifice 60. Also, the location of tap 28 above the bottom of chamber 26 creates collection space 30 for any small amount of fluid entering chamber 26 to prevent the fluid from entering secondary air vent valve 18. In the illustrated embodiment, collection space 30 is approximately 2 to 3 inches in height. The presence of collection space 30 is particularly useful for fire suppression wet pipe systems, which must be placed back into operation daily even for maintenance that may expand several days. In such circumstances, system 52 must be repeatedly drained and refilled daily, thus allowing more fluid to enter chamber 26 without entering secondary air vent valve 18 and allowing the fluid to eventually evaporate. Also, the ability to pass air through both primary and secondary air vent valves 12, 18 allows air to enter fluid system 52 as it is being drained. This helps to drain the system by preventing formation of a vacuum in the system.

Thus, it is seen that fire suppression wet pipe system air vent assembly 10 provides redundancy to the primary air vent valve in a manner that not only avoids damage to surrounding structure and inventory from fluid damage, but also provides a ready indicator to a technician on the ground that the assembly is working properly or has failed. Moreover, in the event of a failure, only the failed component needs to be replaced, thus minimizing maintenance expense. Also, in contrast to known fire suppression wet pipe system air vent assemblies, assembly 10 does not need to be wired, at the cost of several hundred dollars or more, into the fire protection alarm panel or other monitoring panels to indicate a failure of the primary air vent valve. Also, in contrast to known fire suppression wet pipe system air vent assemblies, assembly 10 does not need to be accessed and viewed down into the open pan to visually confirm the operational condition of the unit. Viewing from above the unit is difficult in most installations since the assembly is typically 15 to 35 feet above the floor.

Figure 6:
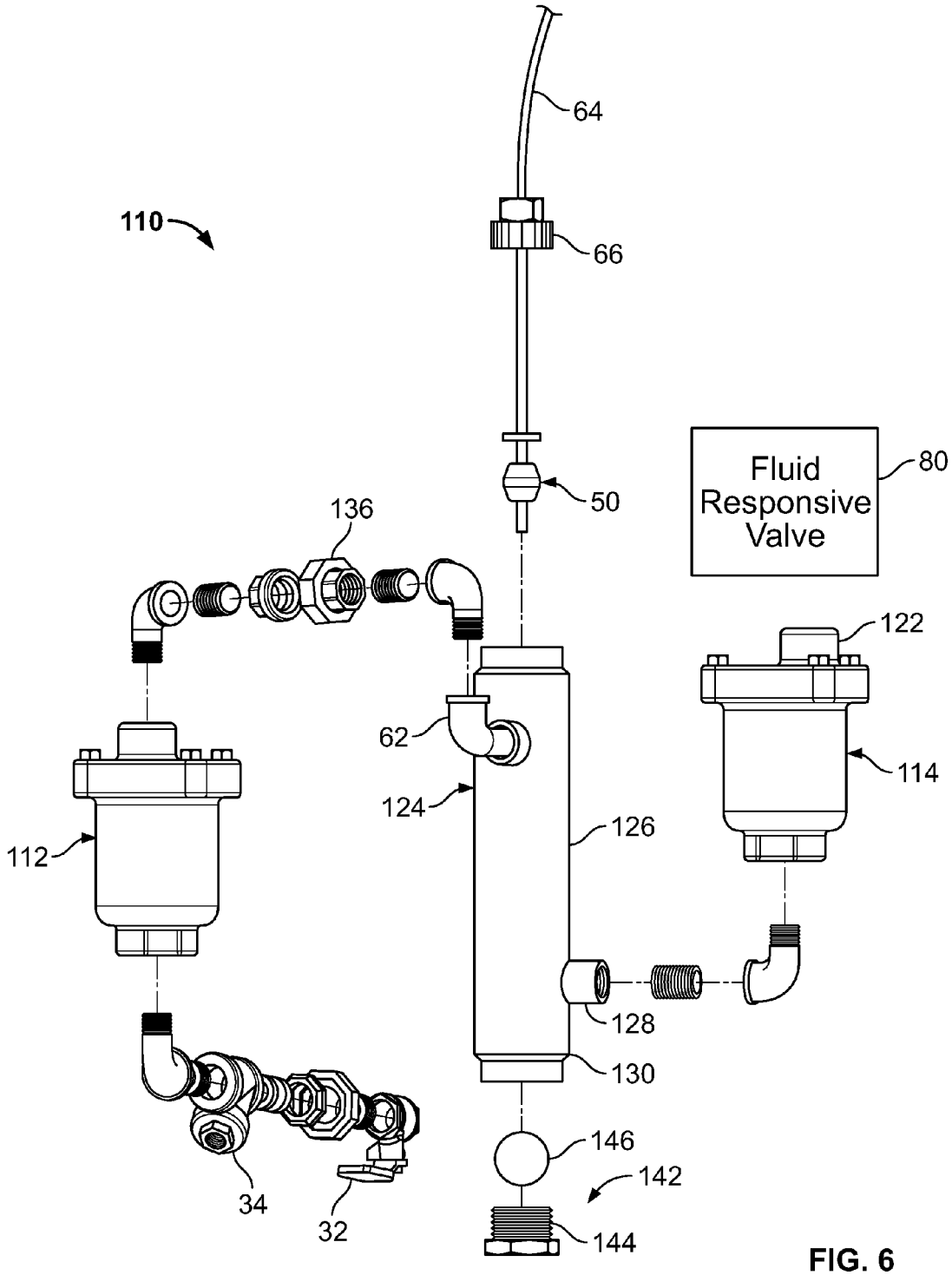
FIG. 6 is an exploded perspective view of an alternative embodiment of a wet pipe system air vent assembly.

In an alternative embodiment, a fire suppression wet pipe system air vent assembly 110 includes a primary air vent valve 112 and a secondary air vent valve 114 that may be the same as valves 12, 18 in the previous embodiment (FIG. 6). A fluid conduit 124 includes a vertically elongated chamber 126 and a coupling 136 that connects with chamber 126 at a side thereof though an "L" 62. This allows the top surface of chamber 126 to be unobstructed. A float-operated electrical switch 50 is positioned in chamber 126 with an electrical cable 64 extending though a cap 66 that closes the chamber. Float-operated switch 50 allows fluid system air vent assembly 110 to be electrically connected with a fire protection alarm panel or other monitoring panel to indicate a failure of primary air vent valve 112. It should be apparent that float-operated switch 50 could be used alone or in combination with a visual indicator 142 made up of a sight glass 144 and indicator element 146 that operate in the same fashion as the previously described embodiment. Assembly 110 may further include a tap 128 that connects secondary air vent valve 114 above the bottom of chamber 126, thus defining a collection space 130 in chamber 126 that functions in the manner previously described. In the illustrated embodiment, float switch 50 is a stainless steel float switch that is commercially available from Chicago Sensor of Ringwood, Ill.

Fire suppression wet pipe system air vent assembly 110 may further include a fluid responsive valve 80 connected with outlet 122 of secondary air vent valve 114. Fluid responsive valve 80 is normally open, but is self-closing in the presence of fluid, such as water, at outlet 122 of secondary air vent valve 114. The purpose of valve 80 is to provide even further failsafe operation to the air vent assembly. In the unlikely event that both primary air vent valve 112 and secondary air vent valve 114 fail in an open state, the presence of water at outlet 122 will cause fluid responsive valve 80 to close, thus providing further failsafe capabilities to air vent assembly 110. Fluid responsive valve 80 may be, for example, a motor-operated ball valve that is operated electrically or pneumatically, or the like. Such a valve is commercially available from various sources, such as Automated Valve Corporation of Novi, Mich. While it is preferred that valve 80 be reusable so that it does not need to be replaced in the event of its operation, non-reusable valves, such as the WAG disclosed in U.S. Pat. No. 6,926,023, may be used.

In the illustrated embodiments, the various components making up fluid system air vent assemblies 10, 110 are made from ferrous and/or cuprous metals, such as cast iron, brass, and stainless steel, for fire suppression wet pipe systems due to the high fluid pressures of such systems. They may be made from other materials for lower pressure applications. In the illustrated embodiments, the various pipe joints are sealed with a Loctite thread sealant which has been found to be less likely to break off and potentially clog an orifice than other joint seal compounds.

Various changes are intended to be comprehended by the various embodiments of the invention. For example, although illustrated with bottom entry air vent valves, assembly 10, 110 could be implemented with side entry valves. Such valves may further reduce the overall height of assembly 10, 110 by one or more inches. This may be useful because assembly 10, 110 is positioned at the highest point in the fluid system, which may have restricted overhead space. The reduction in the overall height of assembly 10, 110 may allow it to fit within such restricted space.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A fire suppression wet pipe system air vent assembly, comprising:

a primary air vent valve having an inlet and an outlet, said primary air vent valve inlet adapted to be connected with a fire suppression wet pipe system, said primary air vent valve configured to vent air but not water from its outlet;

a secondary air vent valve having an inlet and an outlet, said secondary air vent valve configured to vent air but not water from its outlet;

a fluid conduit connecting said primary air vent valve outlet with said secondary air vent valve inlet; and a fluid indicator that indicates the presence of fluid in said conduit, wherein said secondary air vent valve provides failsafe air venting upon the failure of said primary air vent valve and wherein said fluid indicator indicates failure of said primary air vent valve, wherein said fluid indicator comprises a visual indicator that is visible from below said fluid conduit, wherein said visual indicator comprises a sight glass at a bottom portion of said conduit and an indicator element in said conduit that floats away from said sight glass in the presence of fluid in said conduit.

2. The assembly as claimed in claim 1 wherein said conduit comprises a vertically elongated chamber.

3. The assembly as claimed in claim 1 wherein the primary air vent valve and the secondary air vent valve have an identical configuration.

4. The assembly as claimed in claim 1 wherein at least one of the primary air vent valve and the secondary air vent valve comprises a float.

5. The assembly as claimed in claim 1 wherein the outlet of the secondary air vent valve is exposed to atmosphere to allow evaporation of water in the fluid conduit when the secondary air vent valve is open.

6. The assembly as claimed in claim 1 further comprising a fluid responsive valve connected to the outlet of the secondary air vent valve, the fluid responsive valve configured to close in response to water at the outlet of the secondary air vent valve.

7. The assembly as claimed in claim 1 wherein the fluid indicator comprises a float switch in the fluid conduit.

8. A method of venting air from a fire suppression wet pipe system using an automatic air vent assembly, the automatic air vent assembly including a primary air vent valve having an inlet and an outlet, a secondary air vent valve having an inlet and an outlet, and a fluid conduit interconnecting the primary air vent valve and the secondary air vent valve, the primary air vent valve configured to vent air but not water from its outlet, the secondary air vent valve configured to vent air but not water from its outlet, the method comprising:

filling or refilling the fire suppression wet pipe system with water;

and venting air displaced by water in the fire suppression wet pipe system through the automatic air vent assembly including the primary air vent valve and the secondary air vent valve to remove the air displaced by water from the fire suppression wet pipe system;

the secondary air vent valve providing failsafe venting of air but not water from the fire suppression wet pipe system upon a failure of said primary air vent valve.

9. The method as claimed in claim 8 including indicating the presence of water in said fluid conduit.

10. The method as claimed in claim 9 wherein said indicating the presence of water includes giving a visual indication with a visual indicator of the presence of water in said conduit.

11. The method as claimed in claim 10 wherein said visual indicator is visible from below said fluid conduit.

12. The method as claimed in claim 8 including evaporating water in said fluid conduit through said secondary air vent valve.

13. The method as claimed in claim 8 wherein said fluid conduit comprises an enclosed chamber.

14. The method as claimed in claim 13 wherein said secondary air vent valve inlet is connected above a bottom portion of said chamber thereby defining a fluid collection space.

15. The method as claimed in claim 13 wherein said fluid conduit comprises a vertically elongated chamber.

16. The method as claimed in claim 8 wherein venting air includes venting air through a fluid responsive valve connected with said secondary air vent valve outlet, said fluid responsive valve closing in response to water at said secondary air vent valve outlet.

17. The method as claimed in claim 16 wherein said fluid responsive valve comprises a reusable valve.

18. The method as claimed in claim 8 wherein the primary air vent valve and the secondary air vent valve have an identical configuration.

19. The method as claimed in claim 8 wherein at least one of the primary air vent valve and the secondary air vent valve comprises a float.

20. The method as claimed in claim 8 wherein the primary air vent valve and the secondary air vent valve are not wired to a fire protection alarm panel or another monitoring panel.

* * * * *

UNITED STATES PATENT AND TRADEMARK OFFICE

CERTIFICATE OF CORRECTION

PATENT NO. : 8,636,023 B2
APPLICATION NO. : 12/615738
DATED : January 28, 2014
INVENTOR(S) : Burkhart et al.

It is certified that error appears in the above-identified patent and that said Letters Patent is hereby corrected as shown below:

In the Specification

In column 5, line 24, replace “though” with “through”

In column 5, line 27, replace “though” with “through”

Signed and Sealed this
Twenty-second Day of July, 2014

Michelle K. Lee

Michelle K. Lee
*Deputy Director of the United States Patent and Trademark Office*